US005129844A

United States Patent [19]

Goto et al.

[11] Patent Number: 5,129,844

[45] Date of Patent: Jul. 14, 1992

[54] ELECTRICAL WIRE CONNECTOR

[75] Inventors: Kazuhiro Goto, Markham; Gino Menechella, Richmond Hill; Janusz Szyndlar, Unionville, all of Canada

[73] Assignee: AMP Incorporated, Harrisburg, Pa.

[21] Appl. No.: 841,697

[22] Filed: Feb. 26, 1992

Related U.S. Application Data

[63] Continuation of Ser. No. 715,076, Jun. 13, 1991, abandoned.

[51] Int. Cl.[5] ..... H01R 4/32

[52] U.S. Cl. ..... 439/778; 411/2; 439/779; 439/784; 439/792; 439/810

[58] Field of Search ..... 411/1, 2; 439/778, 779, 439/784, 792, 793, 805, 810–814

[56] References Cited

U.S. PATENT DOCUMENTS

| | | | |
|---|---|---|---|
| 1,873,559 | 8/1932 | Dilener | 439/778 |
| 2,471,957 | 5/1949 | Hubbard | 439/778 |
| 3,174,385 | 3/1965 | Hallowell, Jr. | 411/2 |
| 3,742,583 | 7/1973 | Devlin et al. | 411/2 |
| 3,865,246 | 2/1975 | Lieb et al. | 411/2 |

*Primary Examiner*—Paula A. Bradley

*Attorney, Agent, or Firm*—Anton P. Ness; Bruce J. Wolstoncroft

[57] ABSTRACT

An electrical wire connector has a bifurcated bolt having opposed prongs coextending spaced from each other defining a wire-receiving channel therebetween. A nut is threaded onto the bolt until an insert carried by the nut is pressed tightly against one of the two wires disposed along the channel, to clamp the wires tightly against the bottom of the channel and electrically interconnect the wires. The nut has an internally threaded lower section within which a body section of the insert is disposed, and an upper section joined to the lower section at a frangible section adapted to break upon sufficient torque being applied to the nut by a tool, thus providing a torque limit and a visual indication of full assured interconnection. The insert has a lower section depending from the body section having tabs extending outwardly under a lower edge of the nut, for the nut to deflect the tabs downwardly against the wire during final stages of application of the connector to the wires, with the tabs providing stored energy to the center insert portion springably urged against the wire during long-term in-service use.

9 Claims, 3 Drawing Sheets

ELECTRICAL WIRE CONNECTOR

This application is a continuation of application Ser. No. 07/715,076 filed Jun. 12, 1991, now abandoned.

FIELD OF THE INVENTION

The present invention relates to electrical connectors and more particularly to electrical wire connectors for a pair of conductor wires.

BACKGROUND OF THE INVENTION

There are a variety of electrical connectors which electrically interconnect an uninsulated tap conductor wire to an uninsulated main conductor wire at a field site remote from a factory environment and using manual or portable power tools. One conventional type generally comprises a bolt which is split into two prongs extending upwardly from the unsplit bolt end defining a wire-receiving channel in which the main wire and an end portion of the tap wire are disposed, and a nut is torqued onto the bifurcate bolt using conventional manual (or automatic) tools until an insert trapped in the bolt and nut assembly is pressed against a top one of the wires and urges the top wire against the bottom wire and the unsplit end of the bolt. One such connector is sold by Burndy Corporation, Norwalk, Conn. under the trade name SERVIT Service Connectors. Such connectors are also disclosed for example in U.S. Pat. Nos. 1,873,559; 2,137,834; 2,164,006; 2,180,931 and 2,450,158; U.S. Pat. No. 4,147,446 also discloses utilization of a shaped spacer between the pair of wires. The inserts and spacers preferably have shallow V-shaped grooves along their elongate wire-engaging surfaces, which surfaces may be serrated transversely for improved wire engaging characteristics.

It would be desirable to provide a means for assuring that an acceptable level of high compression has been attained using conventional tools.

It would also be desirable to provide a means for improving the longevity of the electrical interconnection under continuous high compression.

SUMMARY OF THE INVENTION

The present invention uses a split bolt onto which is threaded a subassembly of an insert in a nut after the pair of uninsulated wires have been disposed through the channel between the prongs of the bolt, until the bottom of the insert engages the top surface of the upper wire and urges the top wire against the bottom wire which in turn is compressed against the channel bottom defined by the unsplit end of the bolt.

In one aspect of the invention, the nut initially has an upper and a lower section joined at a frangible web, with the lower section threadable onto the bolt prongs and the upper section engaged by a socket of a tool such as a wrench to be rotated. The nut is precision formed so that the upper section breaks off when a selected torque level has been achieved, indicating that a desired level of compression has been attained connecting the wires.

In another aspect of the invention, the insert is of a constant width to fit between the prongs of the split bolt in the wire channel, and preferably is held loosely within the nut to define a subassembly, and be movable with and by the nut. The insert includes an upper section disposed within the lower nut section, and a lower section joined to the upper section at a reduced thickness waist extending the full width of the insert with the lower section depending below the lower nut section. The lower section is elongate having tabs extending outwardly beyond the side surfaces of the upper section to be disposed below and adjacent the lower edge of the lower nut section, with a bottom surface defining an elongate wire-engaging surface; the tabs are adjacent relief recesses which separate the upper surfaces of the tabs from opposing surfaces of the upper section. The wire-engaging surface of the insert extends at an incremental angle upwardly and outwardly defining a central peak which first engages the top wire when the nut is tightened, while the portions of the wire-engaging surface outwardly from the central peak initially are spaced from the wire at the tab ends. As the nut is tightened, the lower edges of the lower nut section engage upper surfaces of the tabs and begin to deflect the tabs relative to the central peak and compress the tabs against the top wire at the locations spaced from the central peak, with full wire engagement of the entire wire-engaging surface eventually attained with sufficient torque. The deflected tabs provide stored energy by tending to urge the central peak therebetween downwardly against the wire during long-term in-service use.

Embodiments of the present invention will now be described by way of example with reference to the accompanying drawings.

DETAILED DESCRIPTION OF THE PREFERRED EMBODIMENTS

Figure 1:
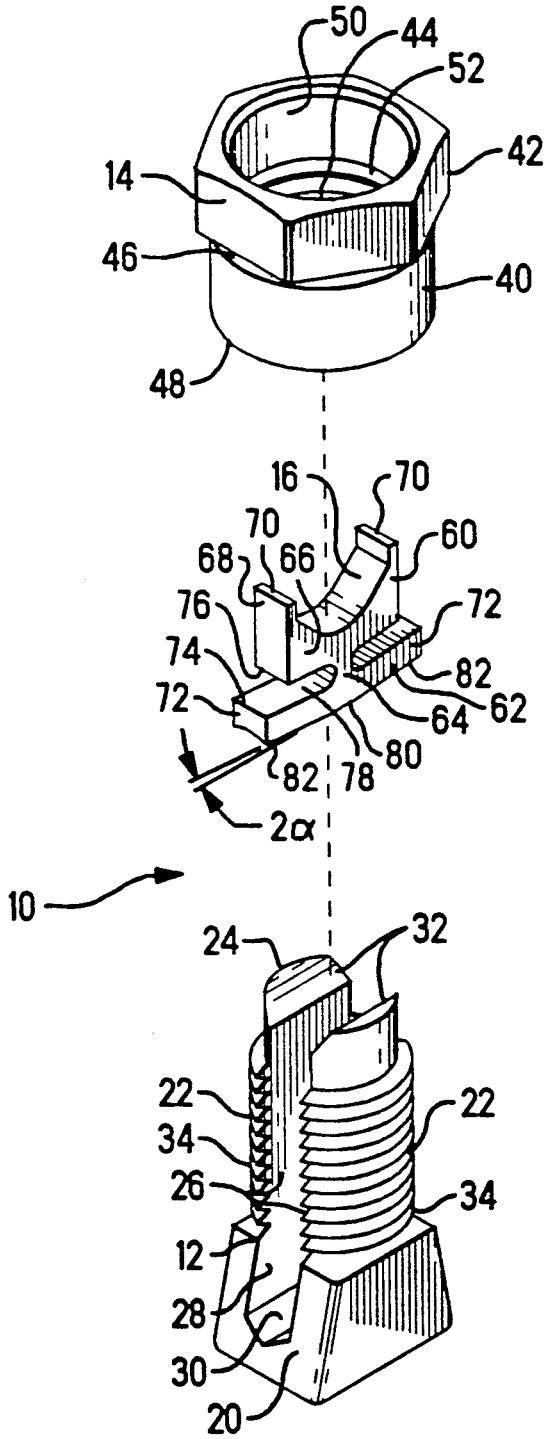
FIG. 1 is an isometric exploded view of the connector of the present invention showing the insert of the present invention and the shear nut of the present invention exploded from the split bolt.

In FIG. 1 connector 10 includes a split bolt 12, a nut 14 and an insert 16 which can be loosely threaded together during handling and shipment prior to application to a pair of wires for electrical interconnection therebetween, and then unthreaded for wire insertion. Bolt 12 includes a transverse body section 20 upwardly from which extend a pair of prongs 22 to free ends 24, with prongs 22 including opposed surfaces 26 spaced from each other a selected distance to define a wire-receiving channel 28 therebetween within which a pair of uninsulated wires will be disposed to be interconnected. Body section 20 defines channel bottom 30 which preferably is slightly V-shaped longitudinally. Free ends 24 preferably include tapered inner edges 32 extending to inner surfaces 26 to define lead-ins facilitating wire insertion and also eventual insert insertion, and free ends 24 are preferably rounded and blunted to remove sharp edges. Prongs 22 have outer surfaces 34 which are disposed about the circumference of a common circle and are threaded complementarily as if bolt 12 had a solid shank for receipt of nut 14 thereonto.

Shear nut 14 includes a lower section 40 and an upper section 42 joined at frangible section 46. Lower section 40 includes a threaded aperture 44 therethrough corresponding to the threads of bolt 12, and includes a lower edge 48. Upper section 42 includes an enlarged aperture 50 extending upwardly from threaded aperture 44 and defining an annular ledge 52 within frangible section 46. Upper section 42 is shaped to be engaged by a socket wrench, for instance, to be rotated and preferably is hexagonal in cross-section. Frangible section 46 is designed to permit upper section 42 to break away from lower section 40 upon a selected torque level achieved during rotation of shear nut 14 about split bolt 12 during wire interconnection.

Insert 16 includes an upper or body section 60 and a lower or wire-engaging section 62 joined to body section 60 at a constricted waist 64. Opposed side surfaces 66 are generally planar and of a width selected to fit within wire-receiving channel 28 of split bolt 12. Body section 60 is of a length between opposed flat vertical end surfaces 68 selected to fit within threaded aperture 44 of shear nut 14. Body section 60 is of a height along end surfaces 68 for upper portions 70 to extend above annular ledge 86 of shear nut 14 when insert 16 is inserted into lower section 40 of shear nut 14; upper portions 70 can then be staked to be deformed outwardly atop ledge 86 to form retention bosses 70A to retain insert 16 within shear nut 14 to facilitate handling prior to wire interconnection.

Lower or wire-engaging section 62 of insert 16 includes a pair of tabs 72 extending outwardly beyond end surfaces 68 of upper section 60 so that upwardly facing surfaces 74 of tabs 72 are disposed below and adjacent lower edge 48 of lower section 40 of shear nut 14. Downwardly facing surfaces 76 of body section 60 outwardly of constricted waist 64 are spaced from upwardly facing surfaces 74 and define relief recesses 78 between body section 60 and tabs 72 of wire-engaging section 62. The bottom or wire-engaging surface of wire-engaging portion 62 has a shallow V-groove therealong, preferably, and the surface extends outwardly from a central peak 80 at incremental angles $\alpha$ to the horizontal to ends 82 of tabs 72; the total angle at central peak 80 is thus $2\alpha$. Angle $\alpha$ may be for example about 1° to about 10° and preferably about 4½.

Bolt 12 may be formed of copper alloy such as high-silicon bronze C65500, and can be formed from a flat blank having a thickness of about 0.115 inches to about 0.190 inches, and the prongs can be formed about a die to be upstanding from the body section to define a channel of controlled width of from about 0.142 inches to about 0.435 inches, as desired, for different wire diameters, all as is conventional, and such as is disclosed in U.S. Pat. No. 2,164,006. Other methods are disclosed in U.S. Pat. Nos. 2,676,390 and 2,770,818 utilizing impact extrusion of the blank.

Shear nut 14 may also be formed of silicon bronze such as by machining, or by impact forming followed by machining of the frangible section 46 and the threads along lower aperture 44.

Insert 16 may be formed such as by impact forming, or by casting or machining, from silicon bronze or beryllium copper.

Alternatively, all three components may be formed in a semisolid impact forming process such as is described in U.S. Pat. Nos. 4,108,643; 4,565,241; 4,569,218 and 4,687,042.

Figure 2:
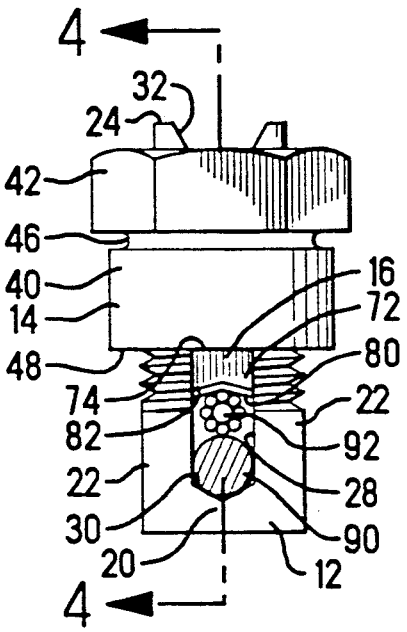
FIGS. 2 and 3 are elevational section views of the connector of FIG. 1 before and after tightening of the shear nut to compress the wires.
Figure 4:
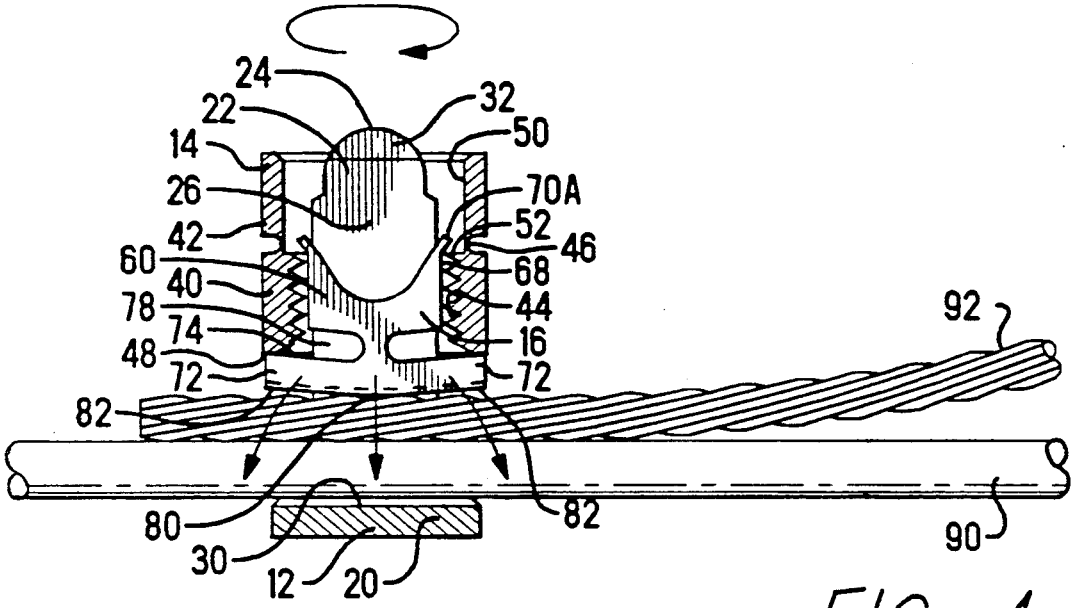
FIGS. 4 and 5 are longitudinal section views of the connector of FIG. 1 before and after tightening of the shear nut to compress the wires, with the nut sheared in FIG. 5.

In FIGS. 2 and 4, the electrical wire connector of the present invention is shown prior to being applied to wires 90,92 which have been disposed within wire channel 28 of split bolt 12 beneath insert 16. Insert 16 is contained within lower section 40 of shear nut 14, as seen in FIG. 4, by reason of upper portions 70 of insert body 60 being deformed outwardly over ledge 52 defining retention means 70A. Shear nut 14 has been rotated until lower edge 48 of lower section 40 rests atop upwardly facing surface 74 of tabs 72 and insert 16 has been brought into engagement with upper wire 92 at central peak 80; outer ends 82 of the wire-engaging surface of insert 16 are slightly spaced above wire 92.

Figure 3:
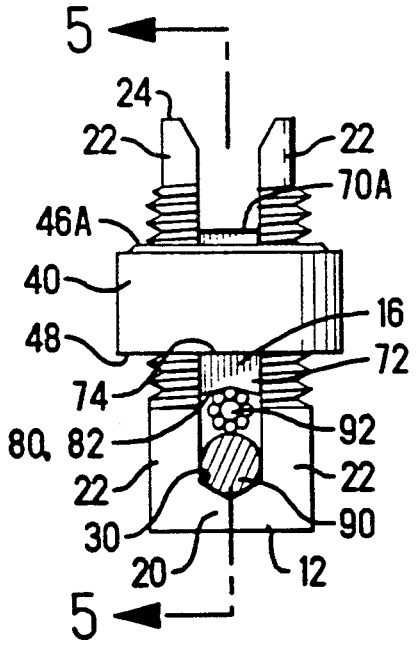
Figure 5:
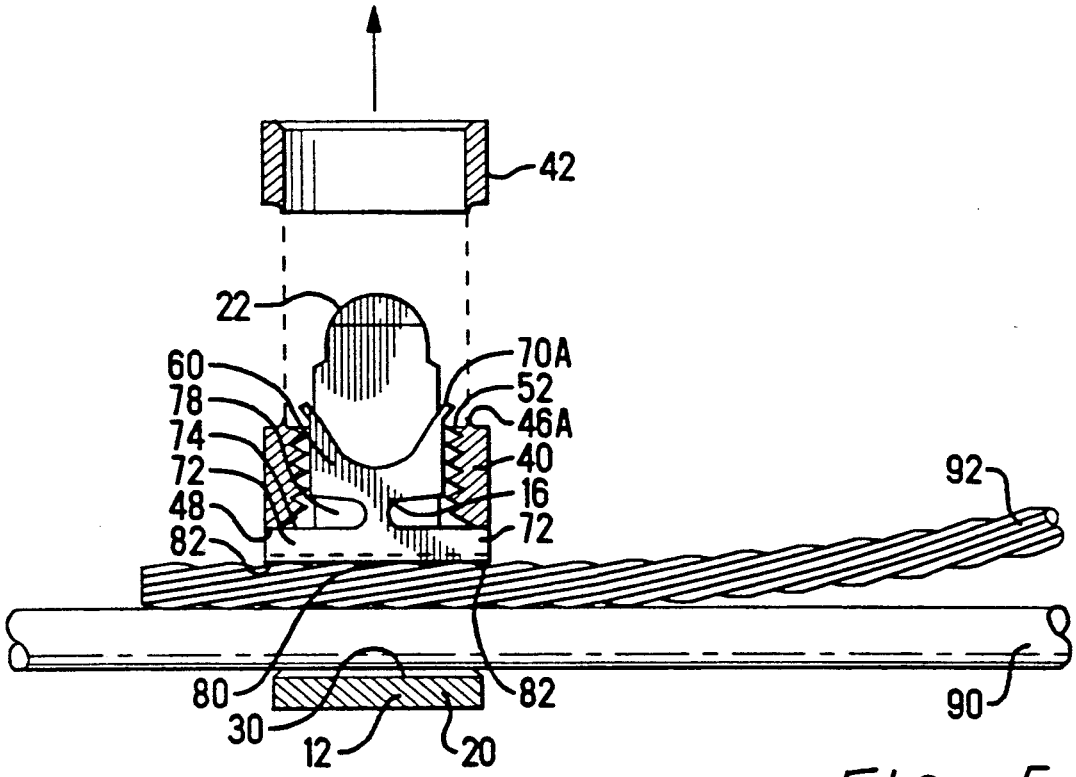

In FIGS. 3 and 5 shear nut 14 has been rotated until tabs 72 have been urged by lower edge 48 into tight engagement with upper wire 92 while central peak 80 remains in tight engagement therewith but is urged upwardly by wire 92, moving body section 60 upwardly within aperture 44 of lower nut section 40 against the stiff spring bias generated by deflection of the center portion of lower insert section 62 with respect to tabs 72. Upper nut section 42 has been broken from lower nut section 40 by reason of exceeding the torque at which frangible section 46 was intended to be broken which may be for example from about 75 inch pounds for 10-gage solid wire to about 350 inch pounds or more for 1000 Mcm wire or greater.

The breaking of upper nut section 42 upon reaching the desired torque selected to create an assured interconnection between the wires, is a visual indication thereof both at the time the interconnection is formed and also thereafter during inspection, since lower nut section 40 is not adapted to be rotated and since sufficient force is present for friction to prevent loosening of lower nut section 40 from split bolt 12.

The insert of the present invention stores energy by tabs continuing after application to urge central peak 80 downwardly against top wire 92, assuring that the entire length of the lower surface of wire-engaging section 62 of insert 16 remains in tight engagement with the top wire therealong, through elevated temperature and vibration.

Various modifications may be made to the shear nut and the insert of the present invention without departing from the spirit of the invention or the scope of the claims.

What is claimed is:

1. An improved electrical wire connector of the type having a bifurcate bolt having two opposed semicylindrical prongs spaced apart to define a wire-receiving channel therebetween and outwardly facing threaded surfaces together defining a common continuously threaded circumference, and a nut threadable onto the common continuously threaded circumference of the bolt about the prongs to urge a wire clamping insert against a top one of two wires disposed along the channel and press both wires tightly against the channel bottom defined by a transverse section of the bolt, the improvement comprising:

said nut having a lower annular section including a threaded aperture therethrough to be threadably received onto said bolt about and around said prongs, and an upper annular section including an inner diameter larger than said threaded aperture and adapted to be rotated during threading of said nut onto said bolt to compress and interconnect said wires, said upper annular section joined to said lower annular section at a frangible section shaped and dimensioned to break upon attaining a selected torque level applied to said upper annular section during said rotation thereof, and said frangible section is adjacent a ledge formed between said threaded aperture through said lower annular section and said larger diameter aperture through said upper annular section, whereby the larger diameter upper annular section permits forming end portions of the insert outwardly and against said ledge to define retention means to carry the wire clamping insert disposed in said lower annular section.

2. The improved connector as set forth in claim 1 wherein said frangible section comprises a thin annular region between said upper and lower annular sections.

3. An improved electrical wire connector of the type having a bifurcate bolt having two opposed semicylindrical prongs spaced apart to define a wire-receiving channel therebetween and outwardly facing threaded surfaces together defining a common continuously threaded circumference and a nut threadable onto the common continuously threaded circumference of the bolt about the prongs to urge a wire clamping insert against a top one of two wires disposed along the channel and press both wires tightly against the channel bottom defined by a transverse section of the bolt, the improvement comprising:

said insert having a body section disposed within said nut and a wire-engaging section depending from said body section and including a central portion directly joined to an supported by said body section, said wire-engaging section further including tabs extending from said central portion to free ends which extend in opposed directions farther outwardly than end surfaces of said body section within said nut so that said tabs extend under a lower edge of said nut and having upwardly facing surfaces adjacent to said lower nut edge, recesses provided between said tab upwardly facing surfaces and opposed surfaces of said body section, said free ends of said tabs adapted to be deflectable about said central portion when wire-engaging bottom surfaces of said free ends of said tabs are urged by said lower nut edge against said top wire and said top wire urges a central portion of said wire-engaging insert section relatively upwardly as said nut is rotated with sufficient force to press said insert and said transverse bolt section together against said wires.

4. The improved connector as set forth in claim 3 wherein said wire-engaging surface of said wire-engaging insert section extends from a central peak at an incremental angle outwardly therefrom to ends of said tabs, whereby said central peak initially engages a top one of said wires during initial stages of connector application to said wires, and said tabs are engaged by said nut as tightening of said nut continues until said tabs are rotated downwardly about said central portion of said insert and against said top wire until application is complete and said insert is tightly compressed against said top wire.

5. The improved connector as set forth in claim 4 wherein said angle is from 1° to about 10° from horizontal.

6. The improved connector as set forth in claim 5 wherein said angle is about 4½.

7. An improved electrical wire connector of the type having a bifurcate bolt having two opposed semicylindrical prongs spaced apart to define a wire-receiving channel therebetween and outwardly facing threaded surfaces together defining a common continuously threaded circumference and a nut threadable onto the common continuously threaded circumference of the bolt about the prongs to urge a wire clamping insert against a top one of two wires disposed along the channel and press both wires tightly against the channel bottom defined by a transverse section of the bolt, the improvement comprising:

said nut having a lower annular section including a threaded aperture therethrough to be threadably received onto said bolt about and around said prongs, and an upper annular section including an inner diameter larger than said threaded aperture and adapted to be rotated during threading of said nut onto said bolt to compress and interconnect said wires, said upper annular section joined to said lower annular section at a frangible section shaped and dimensioned to break upon attaining a selected torque level applied to said upper annular section during said rotation thereof; and said insert having a body section disposed within said nut and said insert further having a wire-engaging section depending from said body section and a central portion directly joined to an supported by said body section, said wire-engaging section further including tabs extending from said central portion, said tabs having free ends which extend in opposed directions farther outwardly than end surfaces of said body section within said nut so that said free ends of said tabs extend under a lower edge of said nut and having upwardly facing surfaces adjacent to said lower nut edge, recesses provided between said tab upwardly facing surfaces and opposed surfaces of said body section, said tabs adapted to be deflectable about said central portion when wire-engaging bottom surfaces of said tabs are urged by said lower nut edge against said top wire and said top wire urges a central portion of said wire-engaging insert section relatively upwardly as said nut is rotated with sufficient force to press said insert and said transverse bolt section together against said wires.

8. The improved connector as set forth in claim 7 wherein said recesses allow incremental relative rotation about said central portion, and said wire-engaging surface of said wire-engaging insert section extends from a central peak at an incremental angle outwardly therefrom to ends of said tabs, whereby said central peak initially engages a top one of said wires during initial stages of connector application to said wires, and said tabs are engaged by said nut as tightening of said nut continues until said tabs are rotated downwardly about said central portion of said insert and against said top wire until application is complete and said insert is tightly compressed against said top wire.

9. The improved connector as set forth in claim 7 wherein said frangible section comprises a thin annular region between said upper and lower annular sections.

* * * * *